US009400482B2

(12) United States Patent
Saito et al.

(10) Patent No.: US 9,400,482 B2
(45) Date of Patent: Jul. 26, 2016

(54) PAPER CONVEYANCE DEVICE, FIXING DEVICE, AND IMAGE FORMING APPARATUS

(71) Applicants: Shohei Saito, Kanagawa (JP); Hideo Nagafuji, Kanagawa (JP); Yuji Arai, Kanagawa (JP); Arinobu Yoshiura, Kanagawa (JP); Kohichi Utsunomiya, Kanagawa (JP); Qifeng Cui, Tokyo (JP); Motoyoshi Yamano, Tokyo (JP); Yutaka Ikebuchi, Kanagawa (JP); Yuichi Harashima, Kanagawa (JP); Yohichi Tsukamoto, Kanagawa (JP); Satoshi Endoh, Kanagawa (JP); Daisuke Sawada, Kanagawa (JP); Yuuki Nobuoka, Kanagawa (JP); Shingo Kuboki, Kanagawa (JP); Takahiro Kikuchi, Kanagawa (JP)

(72) Inventors: Shohei Saito, Kanagawa (JP); Hideo Nagafuji, Kanagawa (JP); Yuji Arai, Kanagawa (JP); Arinobu Yoshiura, Kanagawa (JP); Kohichi Utsunomiya, Kanagawa (JP); Qifeng Cui, Tokyo (JP); Motoyoshi Yamano, Tokyo (JP); Yutaka Ikebuchi, Kanagawa (JP); Yuichi Harashima, Kanagawa (JP); Yohichi Tsukamoto, Kanagawa (JP); Satoshi Endoh, Kanagawa (JP); Daisuke Sawada, Kanagawa (JP); Yuuki Nobuoka, Kanagawa (JP); Shingo Kuboki, Kanagawa (JP); Takahiro Kikuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/644,124

(22) Filed: Mar. 10, 2015

(65) Prior Publication Data

US 2015/0268626 A1 Sep. 24, 2015

(30) Foreign Application Priority Data

Mar. 18, 2014 (JP) ..... 2014-055005
Sep. 10, 2014 (JP) ..... 2014-184582

(51) Int. Cl.
*G03G 21/00* (2006.01)
*G03G 21/16* (2006.01)

(Continued)

(52) U.S. Cl.
CPC ..... *G03G 21/1695* (2013.01); *G03G 15/2028* (2013.01); *G03G 15/6573* (2013.01);

(Continued)

(58) Field of Classification Search
CPC ..... G03G 21/1638; G03G 2221/1675; G03G 21/1633; G03G 2221/169
USPC ..... 399/124
See application file for complete search history.

(56) References Cited

U.S. PATENT DOCUMENTS

2004/0037588 A1 2/2004 Iida
2009/0045567 A1* 2/2009 Youn ..... B65H 5/062 271/109

(Continued)

FOREIGN PATENT DOCUMENTS

JP 2003-241456 8/2003
JP 2004101830 4/2004

(Continued)

OTHER PUBLICATIONS

Machine translation of Masaaki JP 2008-292642 A, publication date: Dec. 4, 2008.*

(Continued)

*Primary Examiner* — Walter L Lindsay, Jr.
*Assistant Examiner* — Frederick Wenderoth
(74) *Attorney, Agent, or Firm* — Duft Bornsen & Fettig LLP

(57) ABSTRACT

A paper conveyance device comprises: a conveyance member having a conveyance surface for conveying a recording medium, the conveyance member extending in a first direction along a front-rear direction of the image forming apparatus that has an opening member for exposing inside of the apparatus, and including a handle disposed on an exposure surface of the opening member, and a swing pivot point that is used to swing the conveyance member around the first direction to expose the conveyance surface when the handle is operated in the open state. The handle is disposed in at least one position in a range between positions near a center of the conveyance member in the first direction. The positions are a certain distance away from the center of the conveyance member along the first direction.

13 Claims, 12 Drawing Sheets

(51) Int. Cl.
*G03G 15/00* (2006.01)
*G03G 15/20* (2006.01)

(52) U.S. Cl.
CPC ..... *G03G21/1633* (2013.01); *G03G 21/1638* (2013.01); *G03G 2215/00544* (2013.01); *G03G 2215/00552* (2013.01)

(56) References Cited

U.S. PATENT DOCUMENTS

| | | | |
|---|---|---|---|
| 2010/0230892 | A1 | 9/2010 | Tanioka |
| 2011/0064451 | A1 | 3/2011 | Yamaguchi et al. |
| 2011/0293326 | A1 | 12/2011 | Tanabe et al. |
| 2013/0170877 | A1 | 7/2013 | Yoshiura et al. |
| 2013/0188991 | A1 | 7/2013 | Kawata et al. |
| 2013/0209139 | A1 | 8/2013 | Ogawa et al. |
| 2013/0236225 | A1 | 9/2013 | Ogawa et al. |

FOREIGN PATENT DOCUMENTS

| | | |
|---|---|---|
| JP | 2008-292642 | 12/2008 |
| JP | 2009120277 | 6/2009 |
| JP | 2013-186287 | 9/2013 |

OTHER PUBLICATIONS

Translation of Aono (JP 2009/120277) listed in the IDS, publication date: Jun. 4, 2009.*
European Communication for EP patent application 15158582.5-1560, the extended European Search report dated Aug. 20, 2015.

* cited by examiner

PAPER CONVEYANCE DEVICE, FIXING DEVICE, AND IMAGE FORMING APPARATUS

CROSS-REFERENCE TO RELATED APPLICATIONS

The present application claims priority to and incorporates by reference the entire contents of Japanese Patent Application No. 2014-055005 filed in Japan on Mar. 18, 2014 and Japanese Patent Application No. 2014-184582 filed in Japan on Sep. 10, 2014.

BACKGROUND OF THE INVENTION

1. Field of the Invention

The present invention generally relates to a paper conveyance device, a fixing device, and an image forming apparatus, and, in particular, to a paper jam removal mechanism.

2. Description of the Related Art

Image forming apparatuses such as copiers, facsimiles, printers, and printing machines that use the electrophotography technology finish copying or printing by fixing an unfixed image composed of unfixed toner that has been transferred and carried on paper that is a recording medium.

Inside an image forming apparatus, provided are conveyance paths for conveying paper, one of which conveys paper that has been passed through a fixing device to a discharging unit. The conveyance path includes conveyance guides disposed such that the conveyance guides face the front surface and the back surface of a sheet of paper, respectively. When a sheet of paper moving through the conveyance path causes a conveyance failure such as a paper jam, the sheet needs to be removed. In particular, a sheet that has passed through the fixing device may curl in some cases because of heat at the fixing process. The leading end of the sheet abuts on a separation claw because of the curling and the sheet is not separated from the fixing device in some cases, whereby conveyance failure may occur.

In order to remove a sheet from a conveyance path to recover from the conveyance failure, for example, a technology has been developed as in Japanese Patent Application Laid-open No. 2013-186287. The technology discloses an image forming apparatus including a display portion that indicates a location at which conveyance failure is occurring. In accordance with the indication, a user opens an outer cover at the location and then opens a conveyance cover to expose the conveyance path to outside.

Another technology has also been developed as in Japanese Patent Application Laid-open No. 2008-292642, that discloses an image forming apparatus including a fixing cover open-close mechanism. With the mechanism, a conveyance guide is opened in association with an open-close movement of an outer cover of the image forming apparatus.

When an image forming apparatus includes a configuration for removing a sheet that causes a paper jam, the configuration is complicated if the image forming apparatus includes a configuration for displaying where the paper jam is occurring or an open-close mechanism with which a conveyance cover is operated in association with an open-close operation of an outer cover. In particular, when the image forming apparatus includes the configuration for displaying where a paper jam is occurring, the image forming apparatus needs extra wiring for a display member. Parts disposed near the fixing device are largely affected by heat compared to the other parts of the image forming apparatus, so that a heat-resistant processing or heat-insulating structure is needed for the parts such as wiring harnesses. Consequently, the structure becomes more complicated and the production cost increases. When the image forming apparatus includes an open-close mechanism that operates a conveyance guide in association with the movement of the outer cover, the user cannot see where to remove the misconveyed sheet very well but can open the conveyance guide without touching it. In the same manner as in the case of providing a display portion for the image forming apparatus, the configuration of the open-close mechanism becomes more complicated and production cost such as assembly cost increases. These problems occur not only in the paper conveyance configuration of the fixing device but paper conveyance configurations of other devices, and also occur in an image forming apparatus that forms images by using a technology different from electrophotography.

In view of the above-mentioned conventional problems, there is a need to provide a paper conveyance device, a fixing device, and an image forming apparatus that facilitate the open-close operation of a conveyance guide without a complicated structure or a cost increase.

SUMMARY OF THE INVENTION

It is an object of the present invention to at least partially solve the problems in the conventional technology.

According to the present invention, there is provided a paper conveyance device included in an image forming apparatus, the paper conveyance device comprising: a conveyance member having a conveyance surface for conveying a recording medium, the conveyance member extending in a first direction along a front-rear direction of the image forming apparatus, the conveyance member including; an exposure surface that is exposed in an open state in which the image forming apparatus is opened to a second direction corresponding to a direction either to a right side or to a left side of the image forming apparatus to expose inside of the image forming apparatus, a handle disposed in at least one position on the exposure surface in the first direction, exposed in the open state, and operated to expose the conveyance surface in the open state, and a swing pivot point that is used to swing the conveyance member around the first direction to expose the conveyance surface when the handle is operated in the open state, wherein, the handle is disposed in at least one position in a range between positions near a center of the conveyance member in the first direction, the positions being a certain distance away from the center of the conveyance member along the first direction.

The present invention also provides a fixing device comprising: a fixing member that is capable of rotating while being heated by a heat source; an opposite roller that applies pressure to the fixing member in an abutment state in which the opposite roller abuts on the fixing member to form a nip between the opposite roller and the fixing member; and the above-described paper conveyance device, the paper conveyance device including the conveyance surface disposed in a position next to the nip.

The present invention also provides an image forming apparatus, comprising: the above-described paper conveyance device; and an opening member opened in the second direction to expose inside of the image forming apparatus to cause the image forming apparatus to be in the open state.

The present invention also provides an image forming apparatus, comprising: the above-described fixing device; and an opening member opened in the second direction to expose inside of the image forming apparatus to cause the image forming apparatus to be in the open state.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

The following describes an example of an embodiment according to the present invention with reference to the accompanying drawings.

Although an image forming apparatus 100 that includes an example of the paper conveyance device to which the present invention is applied and includes a fixing device installing the paper conveyance device is a printer, the present invention is not limited to this.

Figure 1:
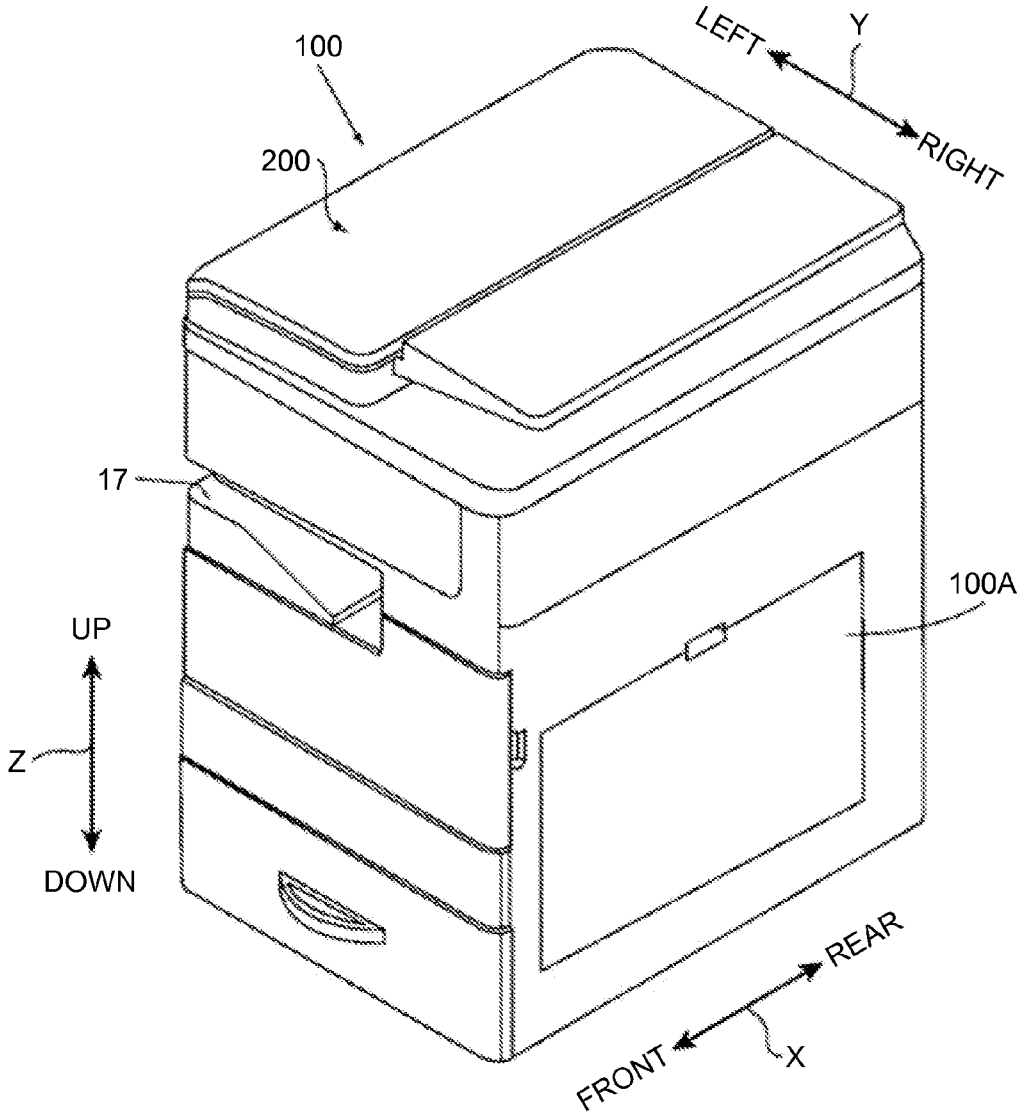
FIG. 1 is an external view of an image forming apparatus including an example of a paper conveyance device according to the present invention.

The image forming apparatus 100 may be a copier or a facsimile, or a multifunction peripheral including the functions of the copier and the facsimile. As illustrated in FIG. 1, the main body of the image forming apparatus 100 is configured with a housing having a shape of a rectangular solid with three sides along the front-rear direction (the direction indicated by an arrow X) as a first direction, the left-right direction (the direction indicated by an arrow Y) as a second direction perpendicular to the first direction, and the up-down direction (the direction indicated by an arrow Z) as a third direction, respectively.

Among the directions described above, the direction indicated by the arrow X corresponds to the depth direction of the image forming apparatus 100 and the width direction of a sheet of paper as a recording medium that is parallel to the longitudinal direction of a fixing member and an opposed rotation member included in a fixing device 20 to be described later.

A document scanning device 200 is installed on the top of an image forming unit to be fully described later with reference to FIG. 2 in the up-down direction (the Z direction) of the image forming apparatus 100. On an upper surface of the image forming apparatus 100 disposed below the document scanning device 200, a paper ejection tray 17 is formed that is used as an in-body paper ejection unit.

Figure 3:
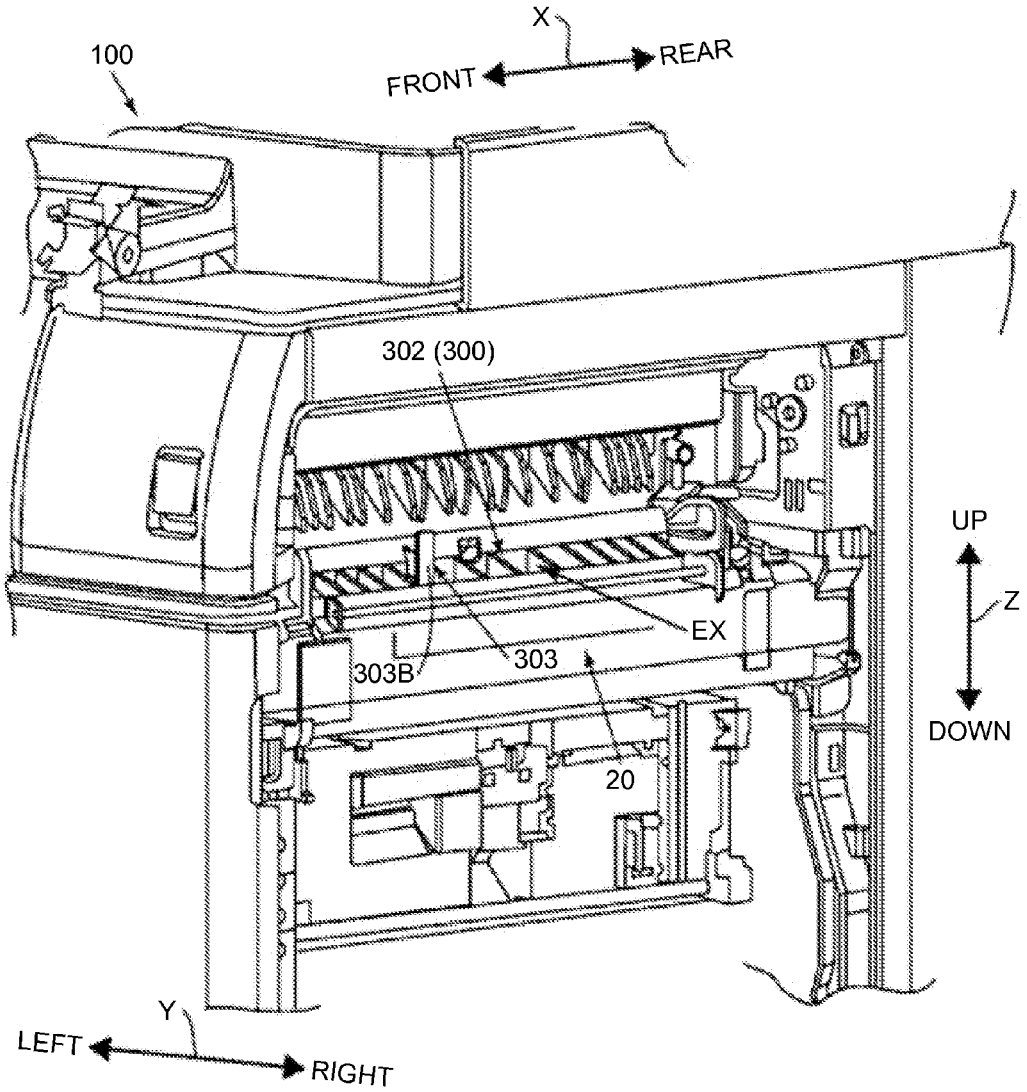
FIG. 3 is an external view of the image forming apparatus illustrated in FIG. 1 with an outer cover being removed.

On a side of the image forming apparatus 100 in the width direction (the Y direction) that is the left-right direction of the image forming apparatus 100, an outer cover 100A is provided. The outer cover 100A is an opening and closing member that can be opened and closed, and the fixing device 20 provided in the image forming apparatus 100 can be seen from outside as illustrated in FIG. 3 by opening the outer cover 100A.

Figure 2:
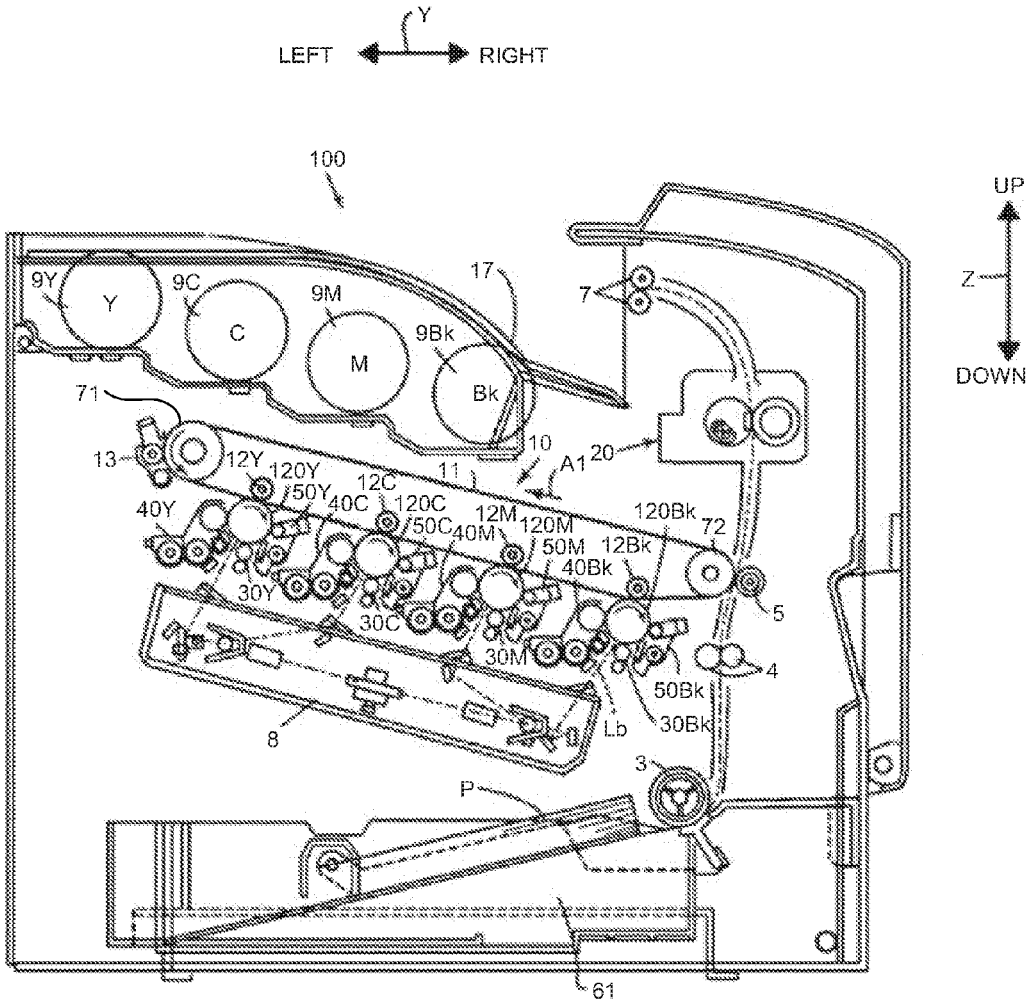
FIG. 2 is a schematic diagram illustrating an internal configuration of the image forming apparatus illustrated in FIG. 1.

The image forming apparatus 100 includes a configuration illustrated in FIG. 2. In FIG. 2, the document scanning device 200 illustrated in FIG. 1 is omitted.

The image forming apparatus 100 illustrated in FIG. 2 sequentially transfers respective visible images formed on photoconductor drums 120Y, 120C, 120M, and 120Bk on to a transfer belt 11 that can move in a direction indicated by an arrow A1 while facing the photoconductor drums 120Y, 120C, 120M, and 120Bk. The transfer belt 11 is an endless track belt that is wound between rollers 71 and 72.

This transfer process corresponds to a first transfer process in which images are sequentially transferred on to the transfer belt 11 to form a superimposition transfer image.

Subsequently, the superimposition transfer image is transferred at once on to sheet P such as a recording sheet in a second transfer process.

Devices are disposed around the respective photoconductor drums 120Y, 120C, 120M, and 120Bk for performing image forming processing in accordance with the rotation of the photoconductor drums. The following describes, as an example, devices around the photoconductor drum 120Bk.

Disposed around the photoconductor drum 120Bk are a charging device 30Bk, a developing device 40Bk, a first transfer roller 12Bk, and a cleaning device 50Bk that perform image forming processing along the direction in which the photoconductor drum 120Bk rotates. Writing performed after the charging involves an optical scanning device 8 to be described later.

The superimposition transfer on to the transfer belt 11 is performed such that, in the course of the moving of the transfer belt 11 in the direction of the arrow A1, visible images formed on the respective photoconductor drums 120Y, 120C, 120M, and 120Bk are sequentially superimposed and transferred on to the transfer belt 11. In the first transfer process, the superimposition transfer is performed such that first transfer rollers 12Y, 12C, 12M, and 12Bk disposed opposite to the photoconductor drums 120Y, 120C, 120M, and 120Bk, respectively, over the transfer belt 11 sequentially apply transfer bias to the transfer belt 11 from the upstream to the downstream of the direction of the arrow A1.

The photoconductor drums 120Y, 120C, 120M, and 120Bk are accommodated in a process cartridge and arranged in this order from the upstream in the direction of the arrow A1.

The photoconductor drums 120Y, 120C, 120M, and 120Bk are provided for image stations for forming a yellow image, a cyan image, a magenta image, and a black image, respectively.

A configuration for performing the first transfer process includes a transfer belt unit 10 including the transfer belt 11 and the first transfer rollers 12Y, 12C, 12M, and 12Bk disposed opposite to the photoconductor drums 120Y, 120C, 120M, and 120Bk, respectively with the transfer belt 11 interposed therebetween.

The images that have been transferred and superimposed on the transfer belt 11 are transferred at once on to the sheet P by the roller 72 and a second transfer roller 5 that is opposite to the roller 72 over the transfer belt 11 and is driven together with the transfer belt 11.

In addition to the process cartridge and the transfer belt unit 10 described above, the image forming apparatus 100 also includes the optical scanning device 8 as an optical writing device disposed below the four image stations and disposed opposite thereto, and includes a cleaning device 13 for cleaning the transfer belt 11.

The optical scanning device 8 includes a semiconductor laser as a light source, a coupling lens, an fθ lens, a toroidal lens, a mirror, and a rotation polygon mirror, for example.

The optical scanning device 8 irradiates the photoconductor drums 120Y, 120C, 120M, and 120Bk with writing light Lb corresponding to the respective colors of the photoconductor drums. Although, in FIG. 2, the reference sign Lb is given to the image station for a black image for convenience, the other image stations are irradiated with the writing light Lb in the same manner. By this processing, electrostatic latent images are formed on the respective photoconductor drums 120Y, 120M, 120C, and 120Bk.

The image forming apparatus 100 includes the following devices.

The image forming apparatus 100 includes a sheet feeding device 61 that feeds the sheet P on which the images transferred and superimposed on the sheet P are transferred at once at the second transfer process, and includes a pair of registration rollers 4 that set a registration timing for the sheet P fed from the sheet feeding device 61 by a feeding roller 3 and draw out the sheet P to a second transfer position. The image forming apparatus 100 also includes a sensor (not illustrated) that detects the leading end of the sheet P when the leading end reaches the pair of registration rollers 4.

After a toner image T transferred and superimposed on the transfer belt 11 is transferred on to the sheet P at once in the second transfer process, the sheet P is conveyed to the fixing device 20 (see FIG. 2) to be described later, at which the toner image is fixed. The sheet P after the fixing process is ejected by paper ejection rollers 7 to the paper ejection tray 17 disposed outside of the main body of the image forming apparatus 100. In FIG. 2, reference signs 9Y, 9C, 9M, and 9Bk are given to tanks for supplying new toner to developing devices provided for the respective image stations in the respective colors.

Figure 4:
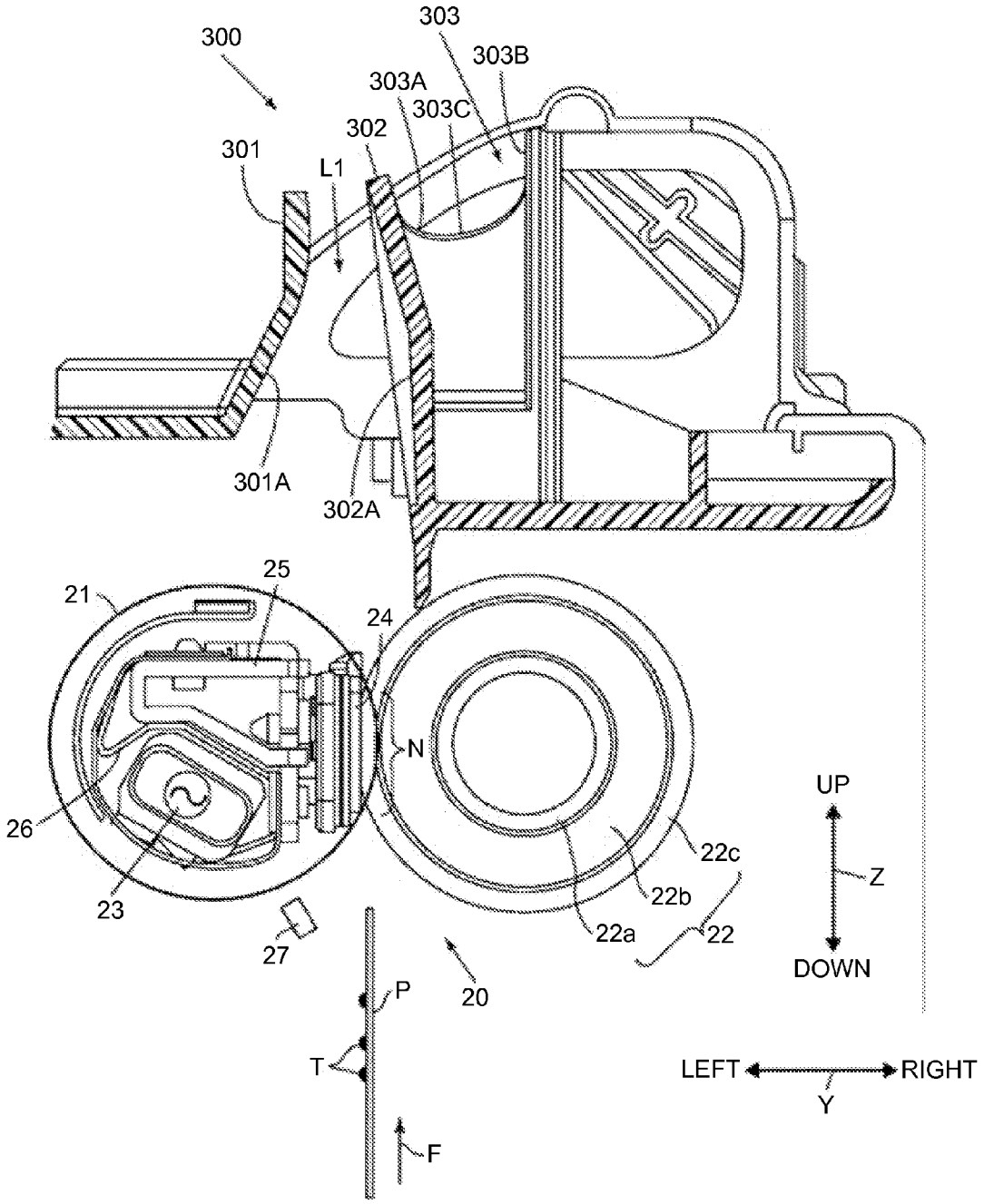
FIG. 4 is a diagram illustrating an internal configuration of a fixing device including an example of the paper conveyance device according to the present invention.
Figure 5:
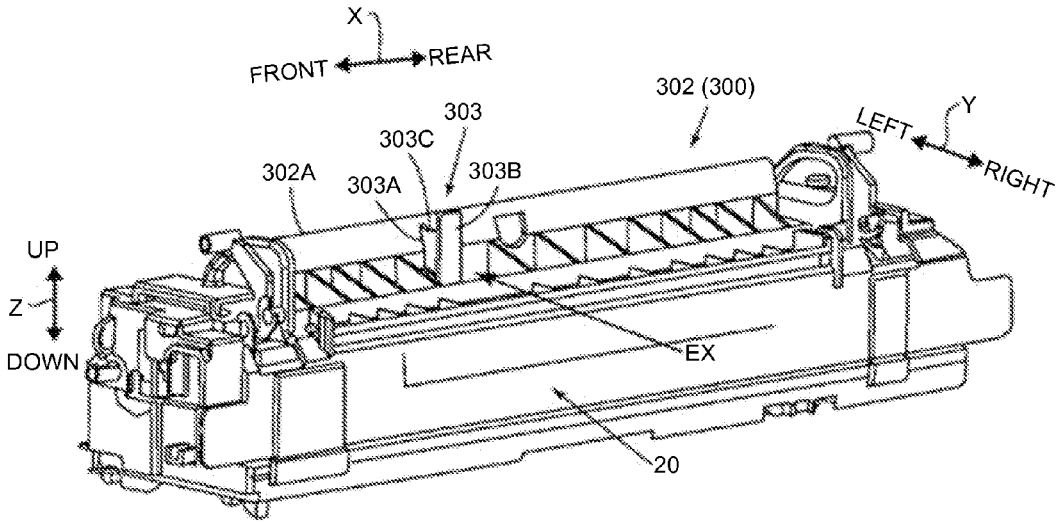
FIG. 5 is an external view of the fixing device illustrated in FIG. 4.

As illustrated in FIG. 4, the fixing device 20 fixes the toner image T carried on the sheet P after the second transfer process by applying heat and pressure to the toner image T so that the toner image T is fused and permeates the sheet P. The fixing device 20 includes a flexible fixing belt 21 that can rotate while being heated.

In addition to the fixing belt 21, the fixing device 20 includes a pressing roller 22 that is an opposite roller abutting on the fixing belt 21 and applying pressure to the fixing belt 21 to form a nip N between the pressing roller 22 and the fixing belt 21. Inside the fixing belt 21, a heater 23 whose heat source is a halogen lamp is provided to heat the fixing belt 21 moving around the heater 23. The fixing belt 21 is heated in an area other than the nip N, that is, in the present embodiment, an area opposite to the nip N.

Inside the fixing belt 21, provided are a nip forming member 24 that is a base member for forming a nip disposed on the inner surface of the fixing belt 21, a stay 25 that supports the nip forming member 24, and a reflecting member 26 that reflects light emitted from the heater 23 to the fixing belt 21.

Although not fully illustrated in FIG. 4, the nip forming member 24 as the base member for forming a nip is formed by a base pad wrapped by a sliding sheet (low friction sheet), and the sliding sheet abuts on the fixing belt 21.

Although the shape of the nip N on the nip forming member 24 illustrated in FIG. 4 is a flat surface, the shape of the nip N is not limited to this. For example, when the nip N is formed in a concave shape along the surface of the pressing roller 22, the leading end of the sheet P that has passed through the nip N leans toward the pressing roller 22, whereby the sheet P can easily be separated from the fixing belt 21.

The temperature of the fixing belt 21 is detected by a temperature sensor 27 disposed at an entrance side of the nip N from which the sheet P enters the nip and is used for feedback processing for the heater 23. In FIG. 4, an arrow F indicates a conveyance direction of the sheet P.

The fixing belt 21 is a thin, flexible endless belt formed in a sleeve shape and includes a base material and a release layer formed on the surface of the base material.

The base material is metal such as nickel or stainless steel, or resin material such as polyimide. The release layer is composed of, for example, tetrafluoroethylene perfluoroalkylvinylether copolymer (PFA) or polytetrafluoroethylene (PTFE) that has releasability from toner.

The pressing roller 22 includes a cored bar 22*a*, an elastic layer 22*b* composed of foamed silicone rubber, silicone rubber, or fluoro rubber provided on the surface of the cored bar 22*a*, and a release layer 22*c* composed of PFA or PTFE provided on the surface of the elastic layer 22*b*. The pressing roller 22 is pressed by a pressing unit (not illustrated) to the fixing belt 21 and abuts on it, and abuts on the nip forming member 24 that is the base member over the fixing belt 21.

At the portion at which the pressing roller 22 abuts on the fixing belt 21, the pressing roller 22 presses the fixing belt 21 and the elastic layer 22*b* of the pressing roller 22 is flattened, so that the nip N having a certain width is formed on the nip forming member 24.

The pressing roller 22 is driven by a driving source (not illustrated) to rotate such as a motor provided in the main body of the printer. When the pressing roller 22 rotates, the driving force is transferred to the fixing belt 21 at the nip N, and the fixing belt 21 is driven to rotate.

Although, in the configuration illustrated in FIG. 4, the pressing roller 22 is a solid roller, the pressing roller 22 may be a hollow roller. In this case, a heat source such as a halogen heater emitting radiant heat can be disposed inside the pressing roller 22. When the pressing roller 22 does not have the elastic layer 22*b*, heat capacity of the pressing roller 22 is reduced and the fixing property is increased. However, when unfixed toner is pressed and fixed on the sheet P, minute unevenness on the surface of the fixing belt 21 may be transferred on an image on the sheet P and may cause uneven brightness in a solid area of the image. To prevent this, providing an elastic layer of equal to or more than 100 μm thick is desirable. As a pipe metal used for the hollow roller, aluminum or stainless steel can be used. When a heat source is provided inside the pressing roller 22, it is desirable to provide a heat-insulating barrier or a heat reflecting surface processed by mirror finishing on the surface of a supporting member so that the supporting member will not be heated by the radiant heat from the heat source. The heat source included in the pressing roller 22 is not limited to the halogen heater described above, but may be an induction heating (IH) device, a resistance heater, or a carbon heater.

The image forming apparatus 100 including the fixing device 20 as configured as described above is provided with a paper conveyance device for conveying sheets. An example of this paper conveyance device 300 to which the present invention is applied conveys a sheet that has passed through the nip N of the fixing device 20.

As illustrated in FIG. 4, the paper conveyance device 300 constitute a conveyance path extending from the exit side of the fixing device 20 to the paper ejection tray 17 (see FIG. 2) to convey the sheet that has passed through the nip N.

As illustrated in FIG. 4, the paper conveyance device 300 includes a pair of conveyance guides 301 and 302 that are fixing exit guides as conveyance members having conveyance surfaces 301A and 302A for conveying the sheet P used as the recording medium in the image forming apparatus 100. The conveyance guide 301 of the pair of the conveyance guides 301 and 302 is fixed, and the conveyance guide 302 is configured to swing relative to a surface of the sheet P by a configuration to be described later with reference to FIG. 6. The conveyance guide 302 may be hereinafter referred to as a swingable conveyance guide 302.

The arrows X, Y, and Z used in the following description indicate the same directions indicated by the arrows X, Y, and Z illustrated in FIG. 1. In particular, the direction indicated by the arrow X corresponds to the width direction of the sheet that is parallel to the axial direction of the pressing roller 22 used as the opposite roller.

Figure 6:
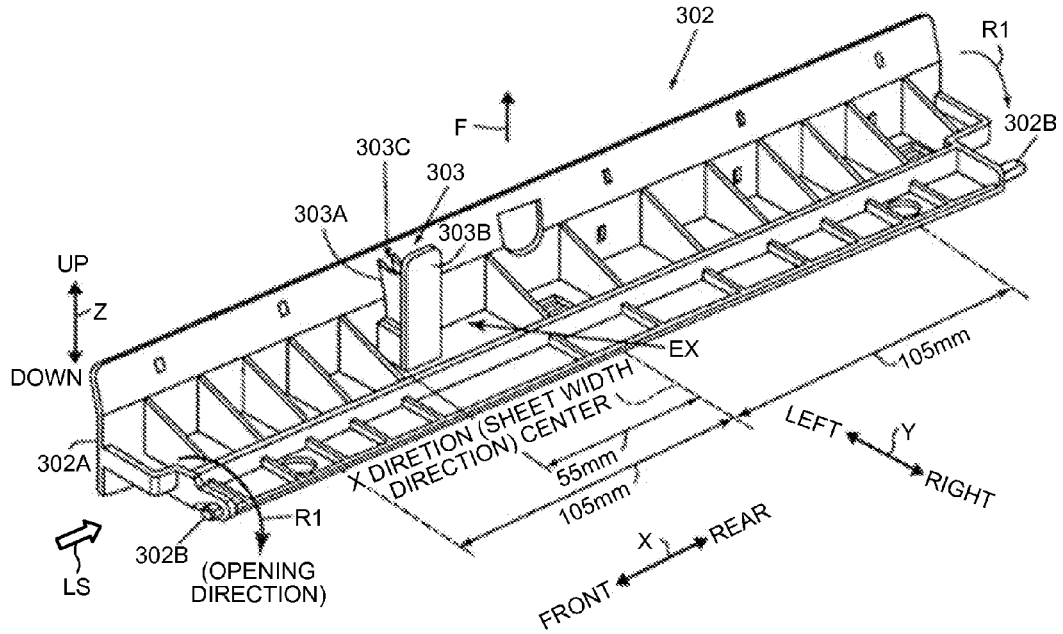
FIG. 6 is a diagram illustrating a configuration of the paper conveyance device according to the present invention.

As illustrated in FIG. 6, the swingable conveyance guide 302 includes the conveyance surface 302A for conveying the sheet P extending in the X direction that is the first direction of the image forming apparatus 100 and can move the sheet P in the paper conveyance direction F.

As illustrated in FIG. 3, the conveyance guide 302 has an exposure surface EX disposed opposite to the conveyance surface 302A. The exposure surface EX is exposed to the outside when the outer cover 100A of the image forming apparatus 100 is opened. In other words, the exposure surface EX is exposed to the outside of the image forming apparatus 100 when the image forming apparatus 100 is opened in the Y direction that is the second direction corresponding to a direction either to the right side or to the left side of the image forming apparatus 100, in the present embodiment, in particular, to the right side of the image forming apparatus 100.

As illustrated in FIG. 6, the swingable conveyance guide 302 includes a swing pivot point 302B for swinging the conveyance guide 302 about the X direction to the right side and the left side of the image forming apparatus 100 when the outer cover 100A of the image forming apparatus 100 is opened. The swing pivot point 302B swings the conveyance guide 302 about the X direction corresponding to the first direction that is the front-rear direction of the image forming apparatus 100 to expose the conveyance surface 302A. Specifically, as indicated by arrows R1 in FIG. 6, the swingable conveyance guide 302 swings in a direction in which the swingable conveyance guide 302 is separated from the conveyance guide 301, and when the swingable conveyance guide 302 swings in this direction, a part of the conveyance path at the exit side of the fixing device 20 is opened.

On the exposure surface EX, a handle 303 is provided that is exposed to the outside when the outer cover 100A is opened and is subsequently operated to expose the conveyance surface 302A of the conveyance guide 302.

The handle 303 is used as an operating unit operated to separate the swingable conveyance guide 302 from the conveyance guide 301 (see FIG. 4).

As illustrated in FIG. 6, the handle 303 is disposed in a position near the center of the exposure surface EX in the X direction that is the first direction of the image forming apparatus 100, and is disposed in a range of 105 mm away from the center of the exposure surface EX in both directions along the X direction. The handle 303 extends from the exposure surface EX toward above the image forming apparatus 100 along the Z direction.

Preferably, the handle 303 is disposed in a position near the center of the exposure surface EX in the X direction that is the reference position in determining the above-described range. More preferably, the handle 303 is disposed in a position at one side of the X direction from the center of the exposure surface EX in the range. FIG. 6 illustrates an example of the handle 303 disposed in a position 55 mm in front of the center of the exposure surface EX in the X direction in the above described range.

By disposing the handle 303 in the above described range, the handle 303 can easily be seen from the front side of the X direction compared to a case in which the handle 303 is disposed in a position at the front end of the X direction, and the handle 303 can easily be reached by a user compared to a case in which the handle 303 is disposed in a position at the rear end of the X direction.

Defining the position of the handle 303 can improve the visibility and operability of the handle 303 from outside. In particular, when the conveyance guide 302 is installed in the image forming apparatus 100 and some other parts are disposed at the front end of the conveyance guide 302 in the X direction, the visibility of the handle 303 is still ensured because the above described configuration can prevent the handle 303 from being hidden by the other parts.

In order to ensure visibility and operability of the handle 303, the handle 303 can be provided in two or more positions along the X direction. When two or more handles 303 are provided along the X direction, at least one of the handles 303 is certainly disposed in the above described range. With this configuration, the user can easily recognize the handle 303 disposed near the center, not at an end in the X direction.

As illustrated in FIG. 6, the upper end of a display portion 303B of the handle 303 protrudes relative to the upper end of the conveyance surface 302A included in the exposure surface EX. The upper end of the conveyance surface 302A corresponds to an end of the conveyance surface 302A at the downstream side of the conveyance direction, that is, the Z direction. With this configuration, as illustrated in FIG. 8, the upper end of the display portion 303B of the handle 303 is higher than the upper end of the conveyance surface 302A in the Z direction, thereby improving visibility of the display portion 303B and making a gap therebetween.

The handle 303 has the gap between a surface of the display portion 303B at the conveyance surface 302A side and the exposure surface EX, and the gap is used as a space 303C so that the user can put a figure on the space 303C and pull it out.

Figure 8:
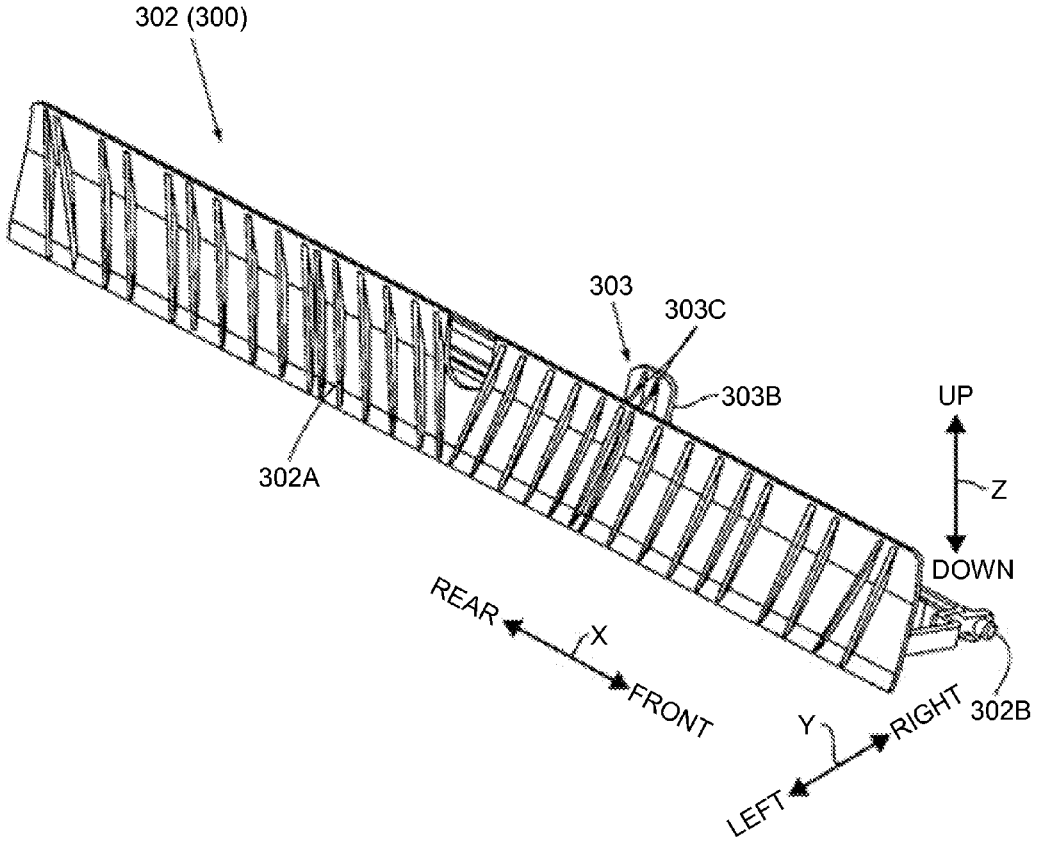
FIG. 8 is a perspective view seen from a direction opposite to the direction in which the paper conveyance device illustrated in FIG. 6 is seen.

Because the display portion 303B protrudes above the conveyance surface 302A, the display portion 303B can be clearly seen from the conveyance surface 302A as illustrated in FIG. 8, and the display portion 303B has the space 303C on which the user puts a finger to operate the handle 303.

As illustrated in FIG. 6, the display portion 303B is configured with a display surface including a flat surface having a wider width in the X direction that is the first direction than that of a joint 303A. The display portion 303B and the joint 303A form a horizontal T-shape when seen from the above, and the display portion 303B corresponds to the top portion of the T-shape. Thus, the display portion 303B has an enough width to be used as the space 303C. In the configuration illustrated in FIG. 6, a pair of joints 303A are provided so as not to cause distortion in the display portion 303B.

Because the display portion 303B has a wide width in the X direction, the user can securely put a finger on the display portion 303B when inserting the finger into the space 303C.

Figure 7:
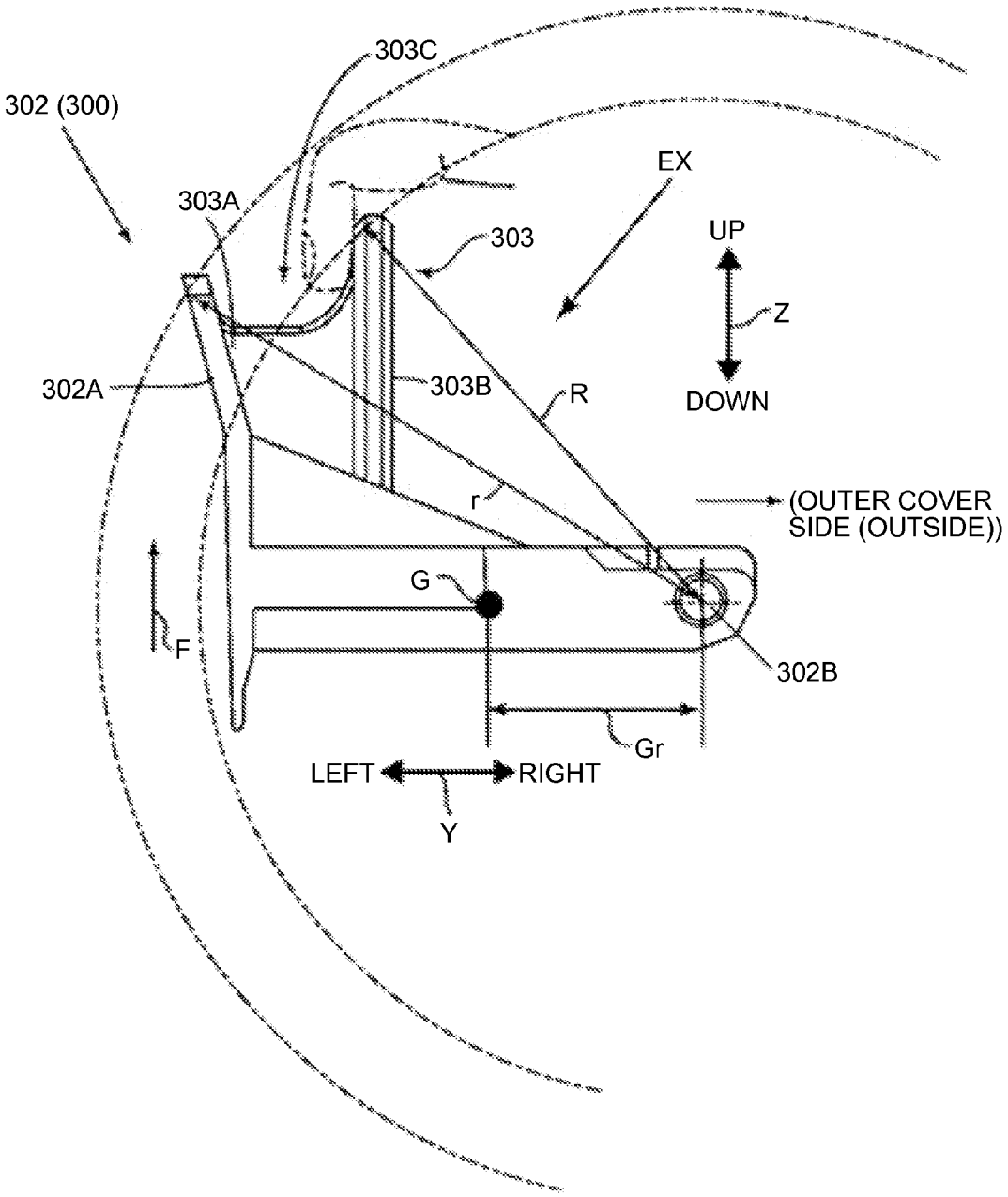
FIG. 7 is a diagram seen from a direction indicated by an arrow LS in FIG. 6.

As illustrated in FIG. 7, the display portion 303B is configured to swing along a rotation trajectory different from the rotation trajectory of the conveyance surface 302A with the swing pivot point 302B being the rotation center.

Specifically, supposing that r represents the maximum radius from the swing pivot point 302B to the swing end of the conveyance surface 302A and R represents the maximum radius from the swing pivot point 302B to the swing end of the display portion 303B, the relation between r and R is r>R.

Accordingly, the display portion 303B swings in a position apart from the conveyance surface 302A and closer to the swing pivot point 302B. When the user opens the conveyance surface 302A, the user operates a portion positioned apart from the conveyance surface 302A, so that the user rarely touches the conveyance surface 302A or the sheet P that has a high temperature caused by the heat from the fixing device 20.

In order to improve the operability of the handle 303, the configuration illustrated in FIG. 7 can be used.

Supposing that R represents the maximum distance from the swing pivot point 302B to the swing end of the handle 303, that is, to the upper end of the handle 303 in the Z direction as described above, and Gr represents the distance from the swing pivot point 302B to the center of gravity G of the conveyance guide 302, the relation between R and Gr is R>Gr, that is, the distance R from the swing pivot point 302B to the upper end of the display portion 303B is larger than the distance Gr from the swing pivot point 302B to the center of gravity G.

In this configuration, the conveyance surface 302A can be opened by operating a part having a larger moment, whereby the conveyance surface 302A can be opened rapidly with a smaller torque.

Figure 10A:
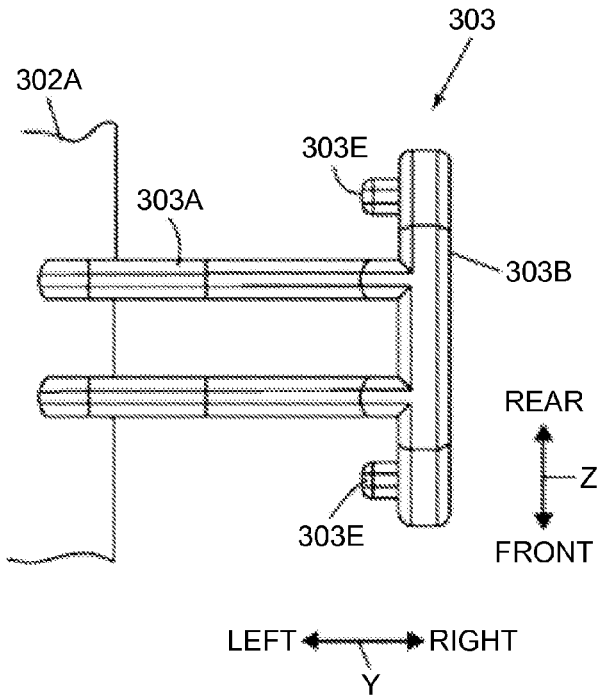
FIG. 10A is a diagram illustrating another example of the configuration illustrated in FIG. 7.
Figure 10B:
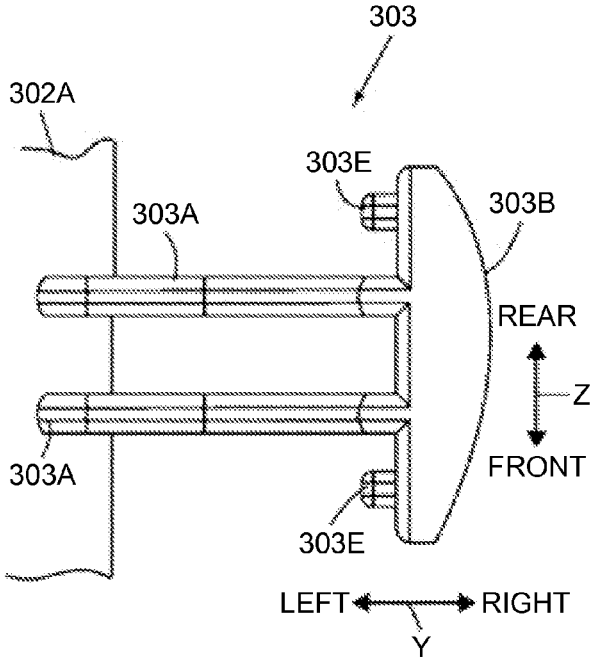
FIG. 10B is a diagram illustrating still another example of the configuration illustrated in FIG. 7

The display portion 303B is a surface opposite to the space 303C that is a gap formed between the display portion 303B and the conveyance surface 302A. The display portion 303B does not necessarily include a display surface having a flat surface that does not have a radius of curvature as illustrated in FIG. 10A. As illustrated in FIG. 10B, for example, the display portion 303B may have a curved display surface having a radius of curvature with the up-down direction, which is the third direction, being the center.

When the display portion 303B has a curved surface curving around the Z direction as the central axis, the user can easily recognize where the display portion 303B is located when the user sees it not only from the swing pivot point 302B, that is, from the Y direction, but also from the X direction.

The flat surface or the curved surface of the display portion 303B can be used to display an indication indicating that this portion is an operating portion used to expose the conveyance surface 302A. Thus, the display portion 303B can display an indication indicating that the portion is an operating portion used in paper jam processing.

In the above described configuration, when operating the swingable conveyance guide 302, the user puts a finger on the handle 303 to swing the swingable conveyance guide 302 in a direction apart from the conveyance guide 301.

As describe above, an end part of the display portion 303B protrudes relative to the conveyance surface 302A, and the display portion 303B is disposed in a position in front of the center of the image forming apparatus 100 in the paper width direction (X direction). When the user opens the outer cover 100A of the image forming apparatus 100, this configuration enables the user to easily recognize a swing operation member from the front side of the image forming apparatus 100 and a side at which the outer cover 100A is opened, compared to a case in which the swing operating member is disposed in a rear end of the image forming apparatus 100 in the X direction.

In an example of the paper conveyance device according the embodiment described above, the handle 303 used for opening and closing the swingable conveyance guide 302 is integrated with the conveyance guide 302. Thus, the handle 303 need not be installed on the conveyance surface 302A in a separate assembling process. This configuration can prevent the assembly cost from increasing, or can lower the assembly cost.

Figure 9:
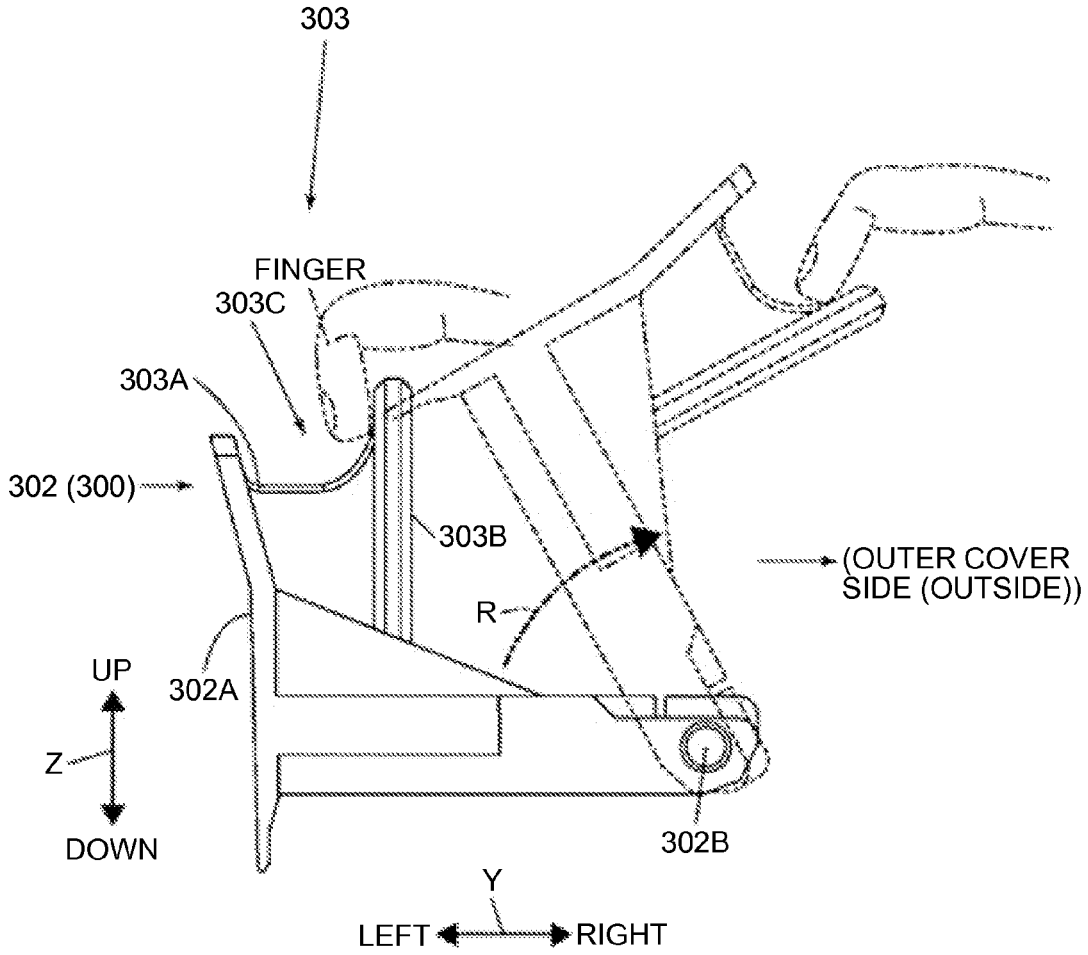
FIG. 9 is a diagram illustrating an effect of the configuration illustrated in FIG. 7.

When the paper jam processing is performed, the conveyance guide 302 swings to a side at which the exposure surface EX is exposed, that is, a side corresponding to the right side of the conveyance guide 302 in the direction of the arrow Y in FIG. 9, and the conveyance guide 302 swings apart from the conveyance guide 301 illustrated in FIG. 4. By this operation, a part of a conveyance path L1 disposed opposite to the conveyance guide 301 is exposed.

In order to expose the exposure surface EX of the swingable conveyance guide 302 from the right side of the image forming apparatus 100 in the Y direction, the outer cover 100A is opened.

When the outer cover 100A is opened, the handle 303 can easily be seen as described above. Moreover, the display portion 303B has the space 303C to which the user inserts a finger to pull it out to open the conveyance guide 302. With this configuration, the user can easily open the conveyance guide 302 without any difficulty.

In an example of the paper conveyance device according the embodiment described above, the handle 303 used for opening and closing the swingable conveyance guide 302 is integrated with the conveyance surface 302A of the conveyance guide 302. Thus, the handle 303 need not be installed on the conveyance surface 302A in a separate assembling process. This configuration can prevent the assembly cost from increasing, or can lower the assembly cost.

When the user swings the conveyance guide 302 to open it, the operability of the handle 303 is important.

Figure 12:
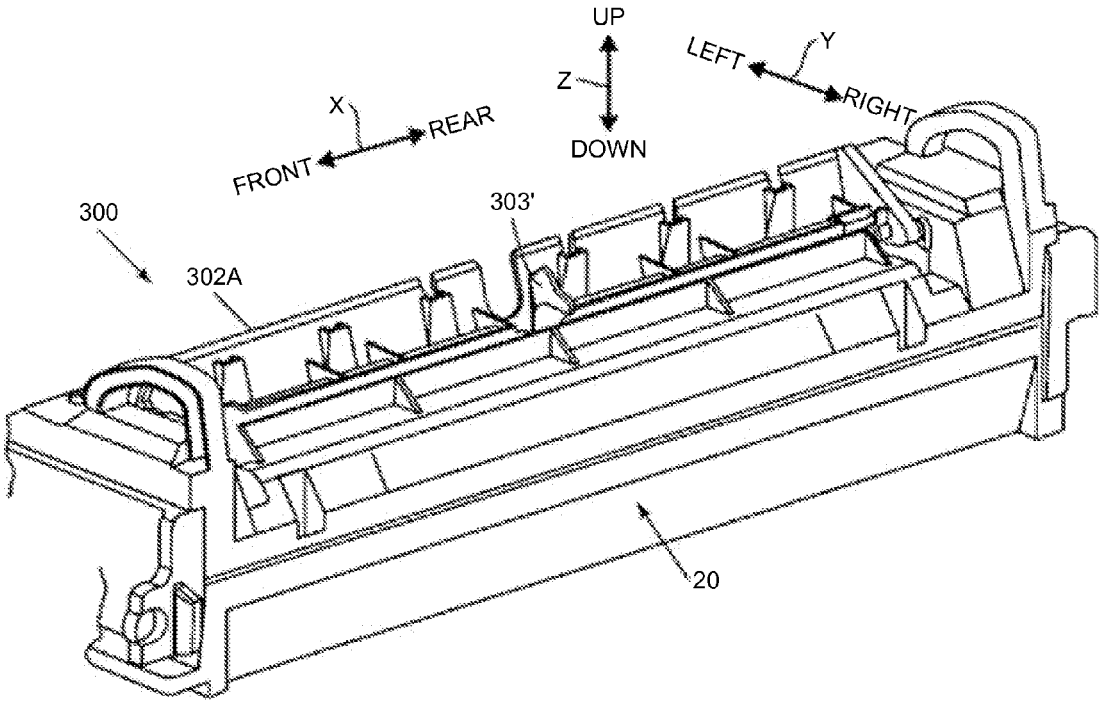
FIG. 12 is a diagram illustrating an external view of an example of a conventional conveyance guide used in a paper conveyance device.

In the above described configuration, the display portion 303B is thicker than the joint 303A in the Y direction so that the display portion 303B has an enough area on which the user puts a finger. With this configuration, the user can easily open the conveyance guide 302 by simply putting a finger on the handle 303 and pulling it out without holding it, compared to a case in which the user operates a handle 303' illustrated in FIG. 12 that has the base and the top end having the same width in the X direction.

In particular, compared to a case in which the user holds a part of the handle 303 near the conveyance surface 302A that has a high temperature because of the heat of the fixing device 20, the user can be free from heat of the fixing device 20 when the user does not hold the handle 303 but puts a finger on a part of the handle 303 distant from the conveyance surface 302A.

In order for the user to securely put a finger on the handle 303, as illustrated in FIG. 10, a plurality of protrusions 303E are provided having a shape of a boss and protruding toward the space 303C disposed opposite to the display surface of the display portion 303B.

Figure 11:
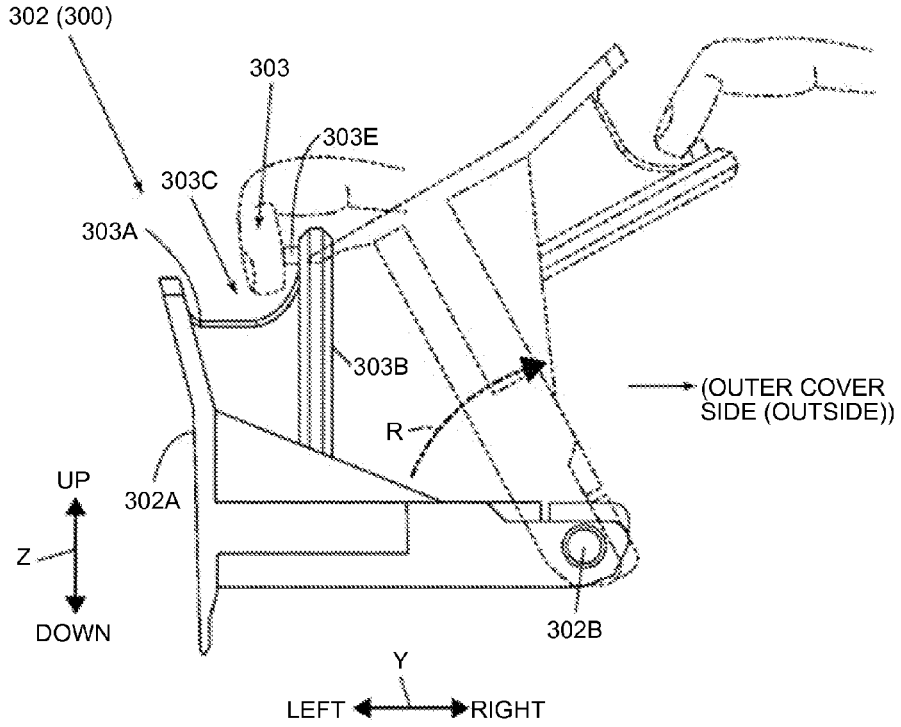
FIG. 11 is a diagram illustrating an effect of the configuration illustrated in FIG. 10A.

Because the boss-shaped protrusions 303E protrude from the opposite surface of the display portion 303B, the user can securely put a finger on the display portion 303B as illustrated in FIG. 11, compared to a case in which the opposite surface is configured with a flat surface. With this configuration, the user can securely put a finger on the display portion 303B, compared to a case in which the opposite surface of the display portion 303B is configured with a flat surface, thereby improving the operability in swinging the swingable conveyance guide 302.

Moreover, when the boss-shaped protrusions 303E are provided on the display portion 303B, the contact area of the finger with the display portion 303B of the handle 303 is reduced. Thus, when the temperature of the swingable conveyance guide 302 is high because of the heat from the fixing device 20, the user can be free from heat by touching only a small area.

Figure 13:
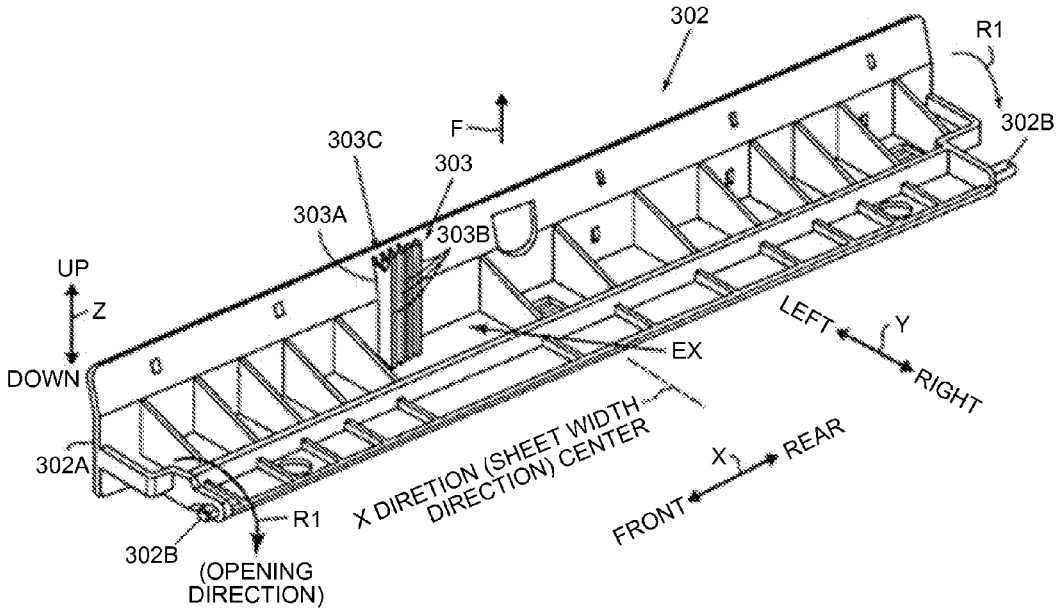
FIG. 13 is an external perspective view illustrating a modification of a display portion illustrated in FIG. 6.

The display portion 303B illustrated in FIGS. 10A, 10B, and 11 is configured with a single surface extending in the Z direction. The display portion 303B is not limited to a single surface, but can be configured with a plurality of surfaces composed of a plurality of linear ribs as illustrated in FIG. 13, and the surfaces are used as the display surface. With this configuration, the amount of resin material for the display portion 303B and the weight thereof can be reduced.

Figure 14:
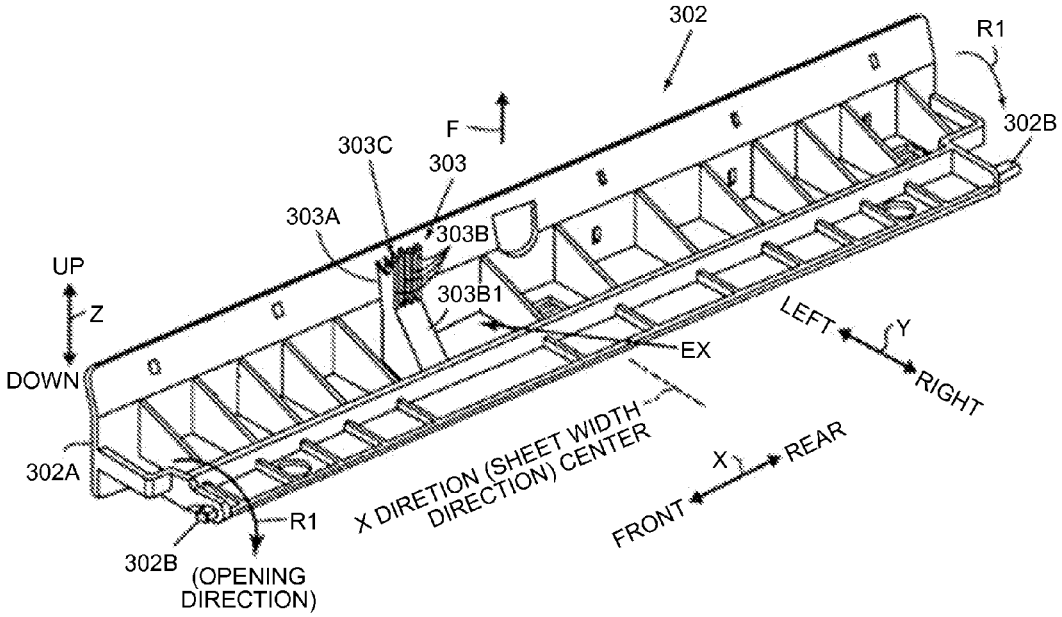
FIG. 14 is an external perspective view illustrating a modification of the display portion illustrated in FIG. 13.

As a modification of the display portion 303B configured with the linear ribs as illustrated in FIG. 13, the display portion 303B can be provided with a slope 303B1 that is a flat surface connected to the lower portion of the linear ribs and is inclined so that the display on the slope 303B1 can be seen from the above as illustrated in FIG. 14.

Figure 15:
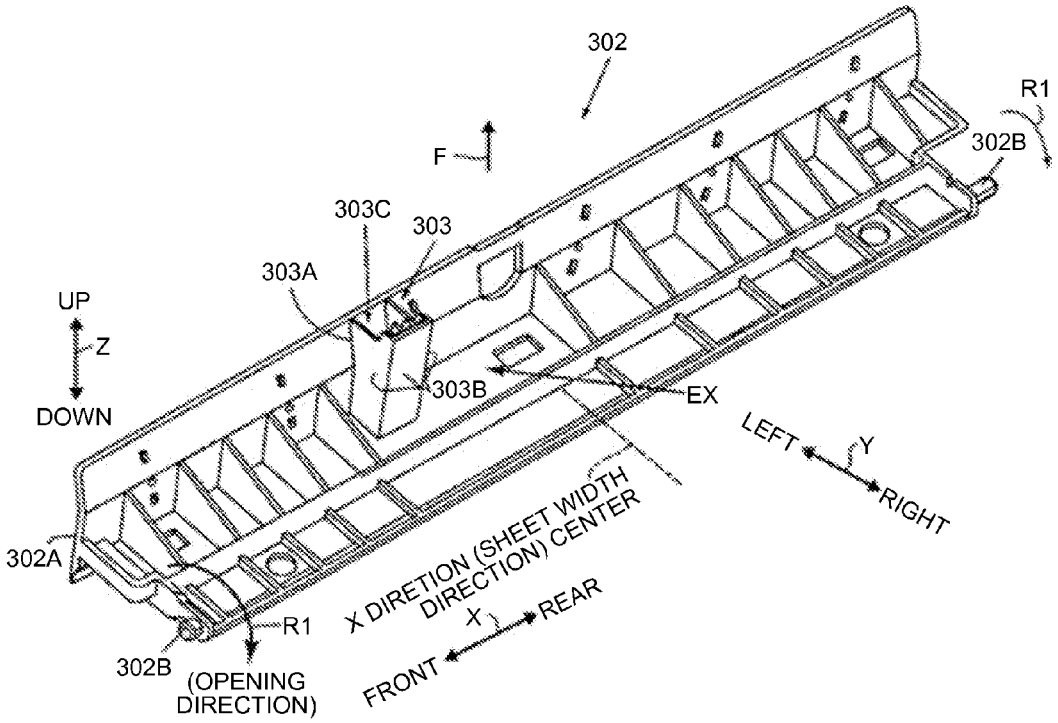
FIG. 15 is an external perspective view illustrating a modification of the display portion illustrated in FIG. 13.

As illustrated in FIG. 15, the handle 303 can be formed in a box shape when seen from the above by connecting the joints 303A of the handle 303 with both ends of the display portion 303B in the X direction. With this configuration, the display portion 303B has three flat surfaces except for a surface facing the conveyance surface 302A on which the display portion 303B can display certain indications. Consequently, the user can recognize the display portion 303B from a plurality of directions, thereby improving the visibility in certain directions.

Figure 16:
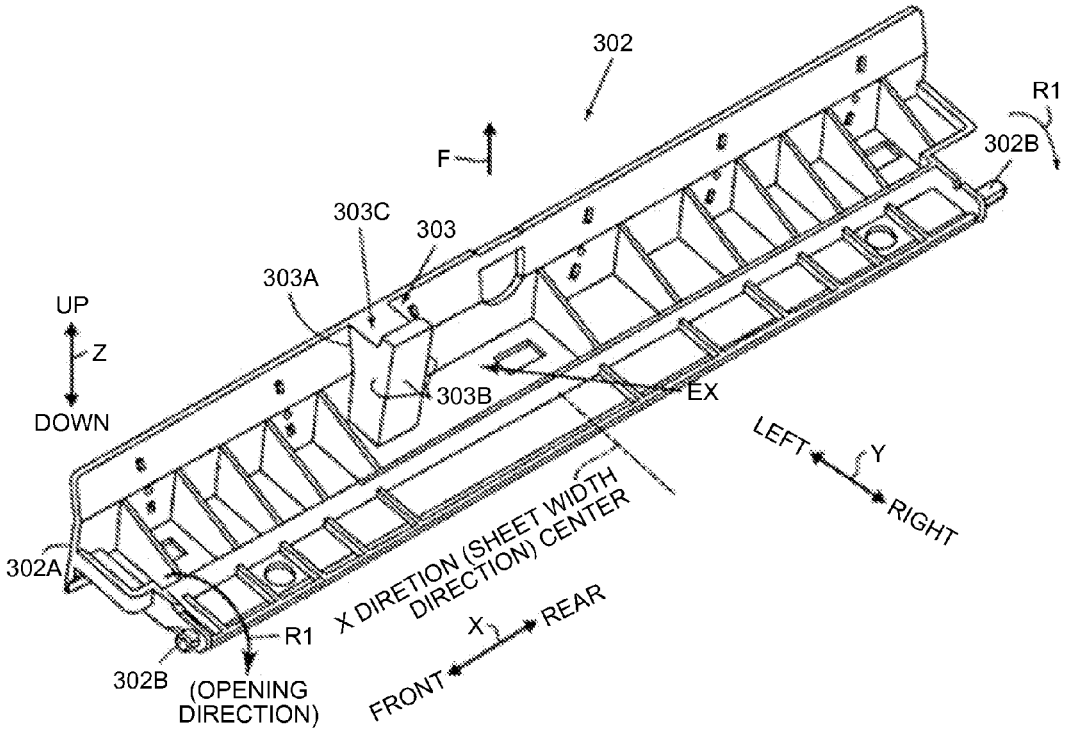
FIG. 16 is an external perspective view illustrating a modification of the display portion illustrated in FIG. 15.

As another example of the display portion 303B having three flat surfaces on which certain indications can be displayed, the handle 303 can be configured with a thick rib having three surfaces as illustrated in FIG. 16.

With any configuration of the configurations illustrated in FIGS. 13 to 16, the user can perform swing operation of the handle 303 by using the space 303C.

Although the preferred embodiment of the present invention is described above, the present invention is not limited to a specific embodiment, but can be changed or modified in various forms within a range of the gist of the present invention as claimed unless otherwise specially limited in the description above. For example, the conveyance guide is not limited to a fixing exit guide that is disposed at the exit side of the fixing device and whose conveyance surface is disposed next to the exit of the nip, but may be a fixing entrance guide whose conveyance surface is disposed next to the entrance of the nip. The conveyance member provided for the fixing device simply needs to be disposed such that the conveyance surface of the conveyance member is disposed next to the nip. The paper conveyance device including the conveyance member may be disposed in a position different from the fixing device in the image forming apparatus to convey a recording medium. It is desirable for the handle to extend in a direction so that the user can easily see the handle from the front side of the image forming apparatus. Thus, the direction in which the handle extends is not limited to the vertical direction as described in the above embodiment, but may be a direction inclined to the above.

The advantageous effects described in the embodiment of the present invention are presented as the most preferable advantageous effects caused by the present invention, and the advantageous effects of the present invention are not limited to those described in the embodiment of the present invention.

According to the present invention, a handle used to expose a conveyance surface is provided in a range from the center of the conveyance surface to a position near the center in a first direction, and the upper end of the handle protrudes to a position different from the conveyance surface, so that a user can easily recognize the handle from outside and can easily open the conveyance surface.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A paper conveyance device included in an image forming apparatus, the paper conveyance device comprising:

a conveyance member having a conveyance surface for conveying a recording medium, the conveyance member extending in a first direction from a front to a rear of the image forming apparatus, the conveyance member including;

an exposure surface that is exposed when a cover is open for viewing into the image forming apparatus along a second direction corresponding to a left to right direction of the image forming apparatus that is perpendicular to the first direction, and a handle configured to rotate the conveyance member about the first direction with a swing pivot point from a closed position to an open position, the handle being disposed on the exposure surface, wherein, in the closed position, the handle extends in a third direction toward a top of the image forming apparatus that is perpendicular to both the first direction and the second direction; and wherein, in the opened position, an exposure of the conveyance surface is increased.

2. The paper conveyance device according to claim 1, wherein the handle is disposed a non-zero distance away and within 105 mm from a center of the conveyance member along the first direction.

3. The paper conveyance device according to claim 1, wherein the handle is disposed closer to the front side of the image forming apparatus than a center of the conveyance member in the first direction.

4. The paper conveyance device according to claim 1, wherein, a gap is formed between the handle and the exposure surface.

5. The paper conveyance device according to claim 4, wherein the handle includes a display portion disposed opposite to the gap, the display portion including a display surface that has a width in the first direction and is capable of displaying an indication indicating that the handle is an operating part for exposing the conveyance surface.

6. The paper conveyance device according to claim 5, wherein the display surface is configured with a single flat surface or a plurality of flat surfaces.

7. The paper conveyance device according to claim 5, wherein the display surface is a curved surface having a radius of curvature with the third direction being a center axis.

8. The paper conveyance device according to claim 4, wherein in the closed position, the handle and the exposure surface extend in the third direction and an end of the handle is positioned above an upper end portion of the exposure surface.

9. The paper conveyance device according to claim 4, wherein a distance between an end of the handle and the swing pivot point is larger than a distance between a center of gravity of the conveyance member and the swing pivot point.

10. The paper conveyance device according to claim 4, wherein the handle includes a plurality of protrusions in the gap.

11. A fixing device comprising:

a fixing member that is capable of rotating while being heated by a heat source;

an opposite roller that applies pressure to the fixing member in an abutment state in which the opposite roller abuts on the fixing member to form a nip between the opposite roller and the fixing member; and the paper conveyance device as claimed in claim 1, the paper conveyance device including the conveyance surface disposed in a position next to the nip.

12. The fixing device according to claim 11, wherein the conveyance member is a fixing exit guide that conveys a recording medium that has passed through the nip.

13. An image forming apparatus, comprising:

the fixing device as claimed in claim 11; and an opening member opened in the second direction to expose inside of the image forming apparatus to cause the image forming apparatus to be in the open state.

* * * * *